US010240416B2

(12) United States Patent
Varkey

(10) Patent No.: US 10,240,416 B2
(45) **Date of Patent: *Mar. 26, 2019**

(54) WIRELINE CABLE FOR USE WITH DOWNHOLE TRACTOR ASSEMBLIES

(71) Applicant: Schlumberger Technology Corporation, Sugar Land, TX (US)

(72) Inventor: Joseph Varkey, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/617,270

(22) Filed: Jun. 8, 2017

(65) Prior Publication Data

US 2017/0268304 A1 Sep. 21, 2017

Related U.S. Application Data

(63) Continuation of application No. 14/705,094, filed on May 6, 2015, now Pat. No. 9,677,359, which is a continuation of application No. 13/497,142, filed as application No. PCT/US2010/049783 on Sep. 22, 2010, now Pat. No. 9,027,657.

(60) Provisional application No. 61/277,219, filed on Sep. 22, 2009.

(51) Int. Cl.

| | |
|---|---|
| ***E21B 23/14*** | (2006.01) |
| ***E21B 19/22*** | (2006.01) |
| ***D07B 1/14*** | (2006.01) |
| *H01B 7/04* | (2006.01) |

(52) U.S. Cl.

CPC ..... *E21B 23/14* (2013.01); *D07B 1/147* (2013.01); *H01B 7/046* (2013.01)

(58) Field of Classification Search

CPC ..... E21B 23/14

See application file for complete search history.

(56) References Cited

U.S. PATENT DOCUMENTS

| | | | |
|---|---|---|---|
| 1,948,439 | A | 2/1934 | Budscheid |
| 1,973,091 | A | 9/1934 | Miller |
| 1,995,071 | A | 3/1935 | Mackenzie |
| 2,002,061 | A | 5/1935 | House |

(Continued)

FOREIGN PATENT DOCUMENTS

| | | | |
|---|---|---|---|
| EP | 0003104 | A1 | 7/1979 |
| EP | 0471600 | A1 | 2/1992 |

(Continued)

OTHER PUBLICATIONS

Examination Report issued n the related CA application 2774775, dated Aug. 16, 2016, (3 pages).

(Continued)

*Primary Examiner* — David J Bagnell
*Assistant Examiner* — Michael A Goodwin
(74) *Attorney, Agent, or Firm* — Eileen Pape

(57) ABSTRACT

A wireline cable includes an electrically conductive cable core for transmitting electrical power, an inner armor layer disposed around the cable core, and an outer armor layer disposed around the inner armor layer, wherein a torque on the cable is balanced by providing the outer armor layer with a predetermined amount of coverage less than an entire circumference of the inner armor layer, or by providing the outer armor layer and the inner armor layer with a substantially zero lay angle.

18 Claims, 8 Drawing Sheets

(56) References Cited

U.S. PATENT DOCUMENTS

| | | | |
|---|---|---|---|
| 2,003,001 | A | 5/1935 | Leece |
| 2,576,227 | A | 11/1951 | Hutchins, Jr. |
| 2,604,509 | A | 7/1952 | Blanchard |
| 3,127,083 | A | 3/1964 | Guyer |
| 3,313,346 | A | 4/1967 | Cross |
| 3,328,140 | A | 6/1967 | Warren |
| 3,346,045 | A | 10/1967 | Knapp et al. |
| 3,482,034 | A | 12/1969 | Rhoades et al. |
| 3,490,125 | A | 1/1970 | Frieling, Jr. |
| 3,634,607 | A | 6/1972 | Coleman |
| 3,679,812 | A | 7/1972 | Owens |
| 3,681,514 | A | 8/1972 | Rhoades et al. |
| 3,710,859 | A | 1/1973 | Hanes et al. |
| 3,758,704 | A | 9/1973 | Naud |
| 3,766,307 | A | 10/1973 | Andrews, Jr. |
| 4,016,942 | A | 4/1977 | Wallis, Jr. et al. |
| 4,059,951 | A | 11/1977 | Roe |
| 4,077,022 | A | 2/1978 | Pitts, Jr. |
| 4,131,757 | A | 12/1978 | Felkel |
| 4,131,758 | A | 12/1978 | Felkel |
| 4,197,423 | A | 4/1980 | Fusen |
| 4,250,351 | A | 2/1981 | Bridges |
| 4,259,544 | A | 3/1981 | Litauer |
| 4,281,716 | A | 8/1981 | Hall |
| 4,292,588 | A | 9/1981 | Smith |
| 4,409,431 | A | 10/1983 | Neuroth |
| 4,486,252 | A | 12/1984 | Lloyd |
| 4,522,464 | A | 6/1985 | Thompson et al. |
| 4,523,804 | A | 6/1985 | Thompson |
| 4,525,813 | A | 6/1985 | Burrage |
| 4,547,774 | A | 10/1985 | Gould |
| 4,577,693 | A | 3/1986 | Graser |
| 4,606,604 | A | 8/1986 | Soodak |
| 4,644,094 | A | 2/1987 | Hoffman |
| 4,645,298 | A | 2/1987 | Gartside, III |
| 4,673,041 | A | 6/1987 | Turner et al. |
| 4,675,474 | A | 6/1987 | Neuroth |
| 4,696,542 | A | 9/1987 | Thompson |
| 4,722,589 | A | 2/1988 | Priaroggia |
| 4,762,180 | A | 8/1988 | Wybro et al. |
| 4,768,984 | A | 9/1988 | de Oliveira et al. |
| 4,825,953 | A | 5/1989 | Wong et al. |
| 4,899,823 | A | 2/1990 | Cobb et al. |
| 4,952,012 | A | 8/1990 | Stamnitz |
| 4,979,795 | A | 12/1990 | Mascarenhas |
| 4,986,360 | A | 1/1991 | Laky et al. |
| 4,993,492 | A | 2/1991 | Cressey et al. |
| 5,002,130 | A | 3/1991 | Laky |
| 5,088,559 | A | 2/1992 | Taliaferro |
| 5,125,061 | A | 6/1992 | Marlier et al. |
| 5,125,062 | A | 6/1992 | Marlier et al. |
| 5,150,443 | A | 9/1992 | Wijnberg |
| 5,329,605 | A | 7/1994 | Wargotz |
| 5,339,378 | A | 8/1994 | Simonds et al. |
| 5,431,759 | A | 7/1995 | Neuroth |
| 5,495,547 | A | 2/1996 | Rafie et al. |
| 5,778,981 | A | 7/1998 | Head |
| 5,787,217 | A | 7/1998 | Traut et al. |
| 5,857,523 | A | 1/1999 | Edwards |
| 5,894,104 | A | 4/1999 | Hedberg |
| 6,015,013 | A | 1/2000 | Edwards et al. |
| 6,030,255 | A | 2/2000 | Konishi et al. |
| 6,053,252 | A | 4/2000 | Edwards |
| 6,060,662 | A | 5/2000 | Rafie et al. |
| 6,161,619 | A | 12/2000 | Head |
| 6,182,765 | B1 | 2/2001 | Kilgore |
| 6,195,487 | B1 | 2/2001 | Anderson et al. |
| 6,211,467 | B1 | 4/2001 | Berelsman et al. |
| 6,276,456 | B1 | 8/2001 | Head |
| 6,386,290 | B1 | 5/2002 | Headworth |
| 6,403,889 | B1 | 6/2002 | Mehan et al. |
| 6,442,304 | B1 | 8/2002 | Crawley et al. |
| 6,484,806 | B2 | 11/2002 | Childers et al. |
| 6,488,093 | B2 | 12/2002 | Moss |
| 6,555,752 | B2 | 4/2003 | Dalrymple et al. |
| 6,559,383 | B1 | 5/2003 | Martin |
| 6,559,385 | B1 | 5/2003 | Johnson et al. |
| 6,600,108 | B1 | 7/2003 | Mydur et al. |
| 6,631,095 | B1 | 10/2003 | Bryant et al. |
| 6,659,180 | B2 | 12/2003 | Moss |
| 6,675,888 | B2 | 1/2004 | Schempf et al. |
| 6,691,775 | B2 | 2/2004 | Headworth |
| 6,745,840 | B2 | 6/2004 | Headworth |
| 6,747,213 | B2 | 6/2004 | Bonicel |
| 6,763,889 | B2 | 7/2004 | Rytlewski et al. |
| 6,776,195 | B2 | 8/2004 | Blasko et al. |
| 6,807,988 | B2 | 10/2004 | Powell et al. |
| 6,834,724 | B2 | 12/2004 | Headworth |
| 6,843,321 | B2 | 1/2005 | Carlsen |
| 6,919,512 | B2 | 7/2005 | Guven et al. |
| 7,000,903 | B2 | 2/2006 | Piecyk et al. |
| 7,119,283 | B1 | 10/2006 | Varkey et al. |
| 7,139,218 | B2 | 11/2006 | Hall et al. |
| 7,170,007 | B2 | 1/2007 | Varkey et al. |
| 7,188,406 | B2 | 3/2007 | Varkey et al. |
| 7,235,743 | B2 | 6/2007 | Varkey |
| 7,282,644 | B1 | 10/2007 | Alvey |
| 7,326,854 | B2 | 2/2008 | Varkey |
| 7,331,393 | B1 | 2/2008 | Hoel |
| 7,402,753 | B2 | 7/2008 | Varkey et al. |
| 7,462,781 | B2 | 12/2008 | Varkey et al. |
| 7,465,876 | B2 | 12/2008 | Varkey |
| 7,586,042 | B2 | 9/2009 | Varkey et al. |
| 7,700,880 | B2 | 4/2010 | Varkey et al. |
| 7,719,283 | B2 | 5/2010 | Ishikawa et al. |
| 7,730,936 | B2 | 6/2010 | Hernandez-Solis et al. |
| 7,798,234 | B2 | 9/2010 | Ju et al. |
| 7,845,412 | B2 | 12/2010 | Sbordone et al. |
| 8,227,697 | B2 | 7/2012 | Varkey et al. |
| 8,387,701 | B2 | 3/2013 | Sbordone |
| 8,413,723 | B2 | 4/2013 | Varkey et al. |
| 8,807,225 | B2 | 8/2014 | Varkey et al. |
| 9,027,657 | B2 | 5/2015 | Varkey |
| 2003/0163179 | A1 | 8/2003 | Hoglund et al. |
| 2004/0163822 | A1 | 8/2004 | Zhang et al. |
| 2004/0262027 | A1 | 12/2004 | Kaczmarski |
| 2005/0217844 | A1 | 10/2005 | Edwards et al. |
| 2005/0219063 | A1 | 10/2005 | Viswanathan et al. |
| 2006/0151194 | A1 | 7/2006 | Varkey et al. |
| 2006/0187084 | A1 | 8/2006 | Hernandez-Marti et al. |
| 2006/0221768 | A1 | 10/2006 | Hall et al. |
| 2007/0003780 | A1 | 1/2007 | Varkey et al. |
| 2007/0044991 | A1 | 3/2007 | Varkey |
| 2007/0158095 | A1 | 7/2007 | Sridhar et al. |
| 2008/0083533 | A1 | 4/2008 | Malone et al. |
| 2008/0156517 | A1 | 7/2008 | Varkey et al. |
| 2008/0190612 | A1 | 8/2008 | Buchanan |
| 2009/0194296 | A1 | 8/2009 | Gillan et al. |
| 2010/0038112 | A1 | 2/2010 | Grether |
| 2010/0263904 | A1 | 10/2010 | Varkey et al. |
| 2012/0222869 | A1 | 9/2012 | Varkey |
| 2014/0352952 | A1 | 12/2014 | Varkey et al. |

FOREIGN PATENT DOCUMENTS

| | | | |
|---|---|---|---|
| EP | 1216342 | A1 | 6/2002 |
| EP | 2039878 | A1 | 3/2009 |
| FR | 2767861 | A1 | 3/1999 |
| GB | 2234772 | A | 2/1991 |
| JP | 54007186 | | 1/1979 |
| JP | 2216710 | A | 8/1990 |
| WO | WO9948111 | A1 | 9/1999 |
| WO | WO0125593 | A1 | 4/2001 |
| WO | WO02071178 | A2 | 9/2002 |
| WO | WO2006003362 | A1 | 1/2006 |
| WO | WO2006027553 | A1 | 3/2006 |
| WO | WO2006088372 | A1 | 8/2006 |

(56) References Cited

FOREIGN PATENT DOCUMENTS

| | | | |
|---|---|---|---|
| WO | WO2007034242 | A1 | 3/2007 |
| WO | WO2011037974 | A2 | 3/2011 |

OTHER PUBLICATIONS

Lebedev, et al., "The breakdown Strength of two-layer Dielectrics", High Voltage Engineering, 1999. Eleventh International Symposium, Conf. Publ. No. 467, vol. 4, Aug. 22-27, 1999, pp. 304-307.
Salama, et al., "Instructional design of multi-layer insulation of power cabels". Power Systems, IEEE Transations, vol. 7, Issue 1, Feb. 1992, pp. 377-382.
International Search Report and Written Opinion issued in the related PCT application PCT/US2010/049783, dated May 9, 2011 (7 pages).
International Preliminary Report on Patentability issued in the related PCT application PCT/US2010/049783, dated Mar. 22, 2012 (5 pages).
Examination Report issued in the related AU application 2010298356, dated Oct. 19, 2015, (3 pages).
Office Action issued in the related MX application MX/a/2012/003397, dated Jun. 30, 2015 (5 pages).
International Search Report and Written Opinion issued in the related PCT application PCT/US2010/031218, dated Nov. 17, 2010 (6 pages).
International Preliminary Report on Patentability issued in the related PCT application PCT/US2010/031218, dated Oct. 18, 2011 (4 pages).
Examination Report issued in the related AU application 2010236397, dated Apr. 22, 2015, (15 pages).
Extended Search Report issued in the related EP Application 10765176.2, dated Mar. 23, 2015 (7 pages).
Office action issued in the related EP Application 10765176.2, dated Nov. 24, 2017 (6 pages).

WIRELINE CABLE FOR USE WITH DOWNHOLE TRACTOR ASSEMBLIES

CROSS-REFERENCE TO RELATED APPLICATIONS

This application is a continuation of co-pending U.S. patent application Ser. No. 14/705,094, filed May 6, 2015, which is a continuation of U.S. patent application Ser. No. 13/497,142, filed May 9, 2012, which is a 371 of International Application No. PCT/US2010/049783, filed Sep. 22, 2010, which claims benefit of U.S. Provisional Patent Application Ser. No. 61/277,219, filed Sep. 22, 2009. Each of the aforementioned related patent applications is herein incorporated by reference.

BACKGROUND

The statements in this section merely provide background information related to the present disclosure and may not constitute prior art.

The invention is related in general to wellsite equipment such as wireline surface equipment, wireline cables and the like.

Deviated wells or wellbores often include extensive horizontal sections in additional to vertical sections. During oilfield operations, it can be particularly difficult to advance tool strings and cables along these horizontal sections. While tool strings descend by gravity in vertical well sections, tractor devices, which are attached to the tool strings are used to perform this task in the horizontal sections, such as those shown in FIG. 1.

In particular, FIG. 1 illustrates a downhole tractor assembly 100 including a tractor 102 coupled to a tool string 104 and a cable 106 coupled to the tool sting 104 opposite the tractor 102. In operation, the tractor 102 pulls the tool string 104 and the cable 106 along a horizontal well section, while a swivel connection 108 coupled between the tool string 104 and the cable 106 minimizes a rotation of the cable caused by a rotation of the tractor 102 and tool string 104.

Several problems are associated with tractor or tractoring operations including torque imbalances in wireline cables that may lead to knotting or bird caging during sudden releases of cable tension. Uneven surfaces of wireline cables can abrade or saw into bends in well casings, which may damage the cable and well casing or cause the cable to become stuck.

A weight of the wireline cables imparts a drag on the tractor and the associated equipments such as a tool string and the like. The speed of travel of the tractor, therefore, is limited by the cable weight. The longer and/or more deviated the well, the more power the tractor requires in order to pull the weight of the cable and associated equipment.

A typical wireline cable with metallic armor wires on the outside diameter thereof has high friction with the wellbore including the casing and the like. Much of the power of the tractor, therefore, is used to overcome the friction between the cable and the wellbore. Due to the high friction between the cable and the wellbore a greater pulling power at the surface is also needed in the event of a tractor failure, wherein the cable is used as a life line to pull the tractor assembly out of the well.

Typical wireline cables have about 98% coverage in their outer armor wire strength member layer to fill the armor wire layer to be able to handle the cable and provide protection for the cable core. Due to this coverage, torque imbalances are inherent in this type of wireline cable, which may cause the cable to rotate during changes in the cable tension.

As the tractor travels down the well it may take a tortuous path and that can rotate the cable. To avoid rotating the cable, a swivel connection is used to connect the cable to the tool string to isolate the tool string from this type of torque. Because torque is generated in the cable when under tension, during a sudden release of that tension, the swivel allows the cable to spin, which can result in opening up of the outer armor wires (i.e. birdcaging) and may disadvantageously cause the cable to loop over itself within the casing.

Mono-cables with alloy armor wires typically comprise a single insulated copper conductor at the core for both electrical transmission and telemetry functions. With mono-cables, electric power is transmitted down the central, insulated power conductor and the electric power returns along the armor. However, with long length alloy cables, electrical power return on them is not possible as a galvanized steel armor package is utilized and the highly resistive nature of alloy wires, such as MP35N and HC-265, effectively precludes the production of long length mono-cables with alloy armors. In order to overcome the above issue, coaxial cables were introduced. With coaxial cables, the electrical power is transmitted down a central, insulated conductor, and returns along a serve layer of stranded copper wires covered by a thin layer of polymeric insulation located near the outer edge of the cable core. However, both mono-cables and coaxial cables have the same disadvantages during tractoring operations, as disclosed above.

It remains desirable to provide improvements in wireline cables and/or downhole assemblies. It is desirable, therefore, to provide a cable that overcomes the problems encountered with current cable designs.

SUMMARY

Embodiments disclosed herein describe a wireline cable and methods for use with tractors in deviated wells that, when compared to typical wireline cables, is not subject to torque imbalance during tension changes, has a lower coefficient of drag, and is lower in weight, with a high strength-to-weight ratio.

In an embodiment, a method comprises: providing a wireline cable, the cable including a cable core and a substantially smooth exterior surface; attaching a tractor to the wireline cable; and introducing the cable into a wellbore, wherein a torque on the cable is balanced and friction between the cable and the wellbore is minimized by the exterior surface.

In an embodiment, a cable comprises: an electrically conductive cable core for transmitting electrical power; an inner armor wire layer disposed around the cable core; and an outer armor wire layer disposed around the inner armor wire layer, wherein a torque on the cable is balanced by providing the outer armor layer with a predetermined amount of coverage of the inner armor wire layer.

In another embodiment, a cable comprises: an electrically conductive cable core for transmitting electrical power; an inner armor layer disposed around the cable core; and an outer armor layer disposed around the inner armor layer, wherein a torque on the cable is balanced by providing each of the inner armor layer and the outer armor layer with a lay angle of substantially zero.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
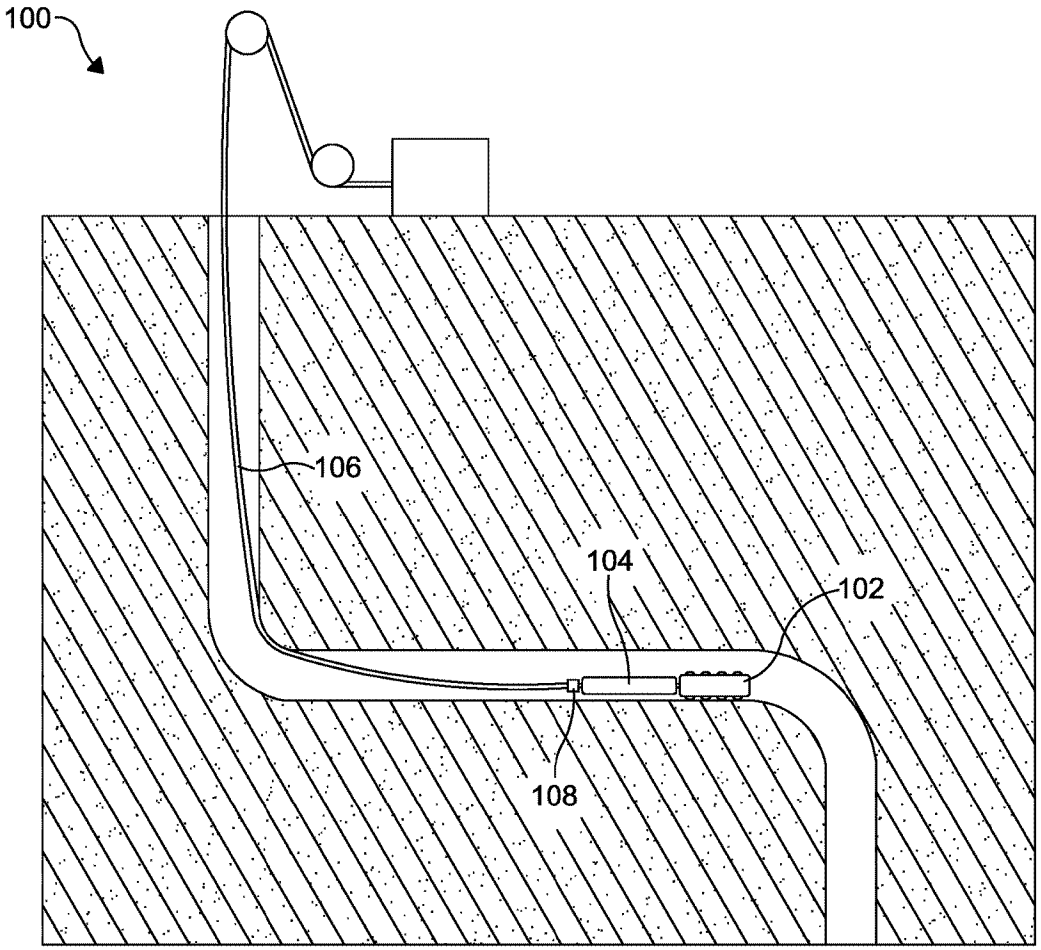
FIG. 1 (PRIOR ART)
FIG. 1 is a schematic representation of a downhole tractor assembly disposed in a wellbore according to the prior art.
Figure 2:
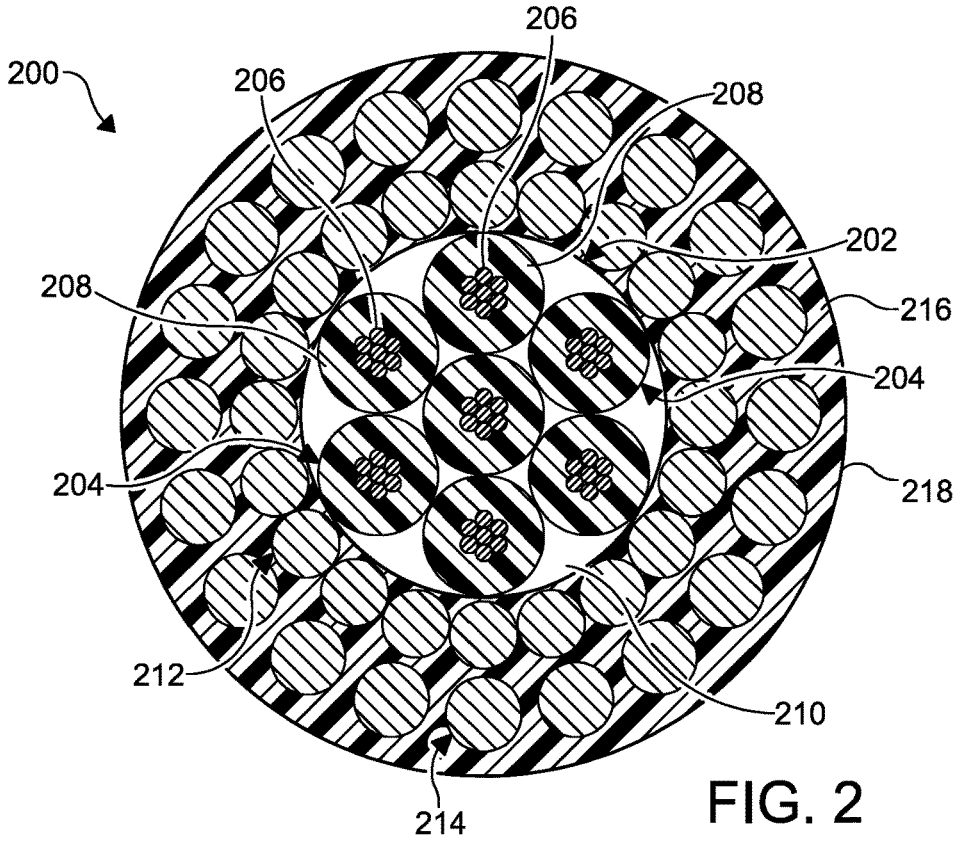
FIGS. 2-14 are a radial cross-sectional views, respectively, of embodiments of a wireline cable.

Referring to FIG. 2, there is illustrated a torque balanced cable 200 for tractor operations according to a first embodiment of the present invention. As shown, the cable 200 includes a core 202 having a plurality of conductors 204. As a non-limiting example, each of the conductors 204 is formed from a plurality of conductive strands 206 disposed adjacent each other with an insulator 208 disposed therearound. As a further non-limiting example, the core 202 includes seven distinctly insulated conductors 204 disposed in a hepta cable configuration. However, any number of conductors 204 can be used in any configuration, as desired. In certain embodiments an interstitial void 210 formed between adjacent insulators 208 is filled with a semi-conductive (or non-conductive) filler (e.g. filler strands, polymer insulator filler).

The core 202 is surrounded by an inner layer of armor wires 212 (e.g. high modulus steel strength members) which is surrounded by an outer layer of armor wires 214. The armor wires 212 and 214 may be alloy armor wires. As a non-limiting example the layers 212, 214 are contra helically wound with each other. As shown, a coverage of the circumference of the outer layer 214 over the inner layer 212 is reduced from the 98% coverage found in conventional wireline cables to a percentage coverage that matches a torque created by the inner layer 212. As a non-limiting example the coverage of the outer layer 214 over the inner layer is between about 60% to about 88%. The reduction in the coverage allows the cable 200 to achieve torque balance and advantageously minimizes a weight of the cable 200. An interstitial void created in the outer layer 214 (e.g. between adjacent ones of the armor wires of the outer layer 214) is filled with a polymer as part of a jacket 216. In the embodiment shown, the jacket 216 encapsulates at least each of the layers 212, 214. As a non-limiting example, that jacket 216 includes a substantially smooth outer surface 218 (i.e. exterior surface) to minimize a friction coefficient thereof. It is understood that various polymers and other materials can be used to form the jacket 216. As a further non-limiting example, the smooth outer jacket 216 is bonded from the core 202 to the outer surface 218. In certain embodiments, the coefficient of friction of a material forming the jacket 216 is lower than a coefficient of friction of a material forming the interstices or insterstitial voids of the layers 212, 214. However, any materials having any coefficient of friction can be used.

In operation, the cable 200 is coupled to a tractor in a configuration known in the art. The cable 200 is introduced into the wellbore, wherein a torque on the cable 200 is substantially balanced and a friction between the cable 200 and the wellbore is minimized by the smooth outer surface 218 of the jacket 216. It is understood that various tool strings, such as the tool string 104, can be attached or coupled to the cable 200 and the tractor, such as the tractor 102, to perform various well service operations known in the art including, but not limited to, a logging operation, a mechanical service operation, or the like.

Figure 3:
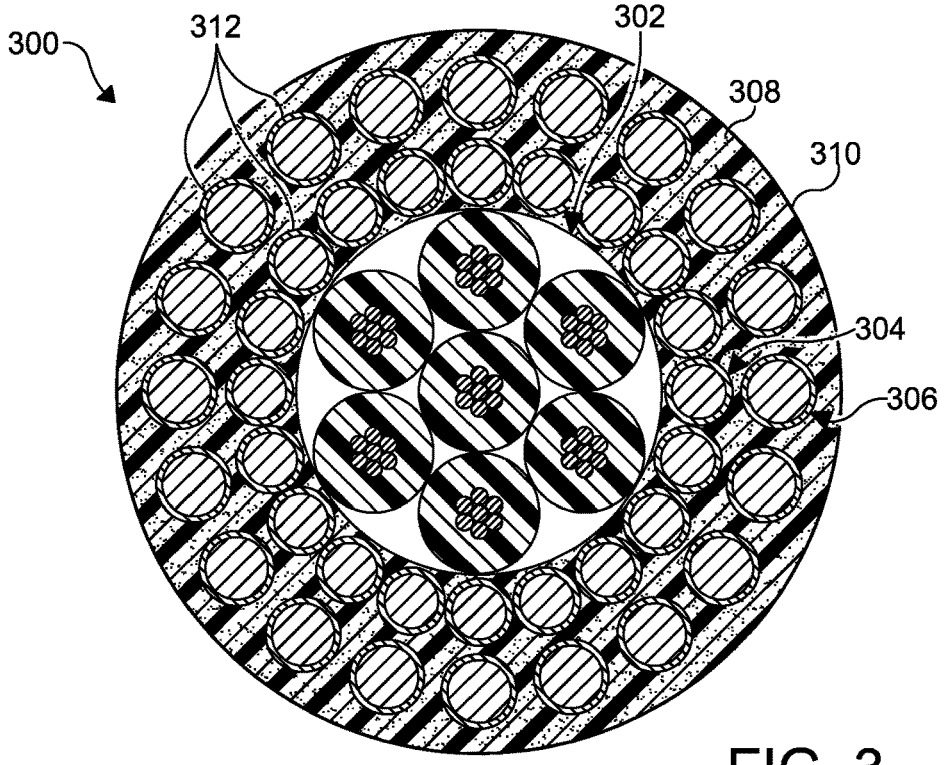

FIG. 3 illustrates a torque balanced cable 300 for tractor operations according to a second embodiment of the present invention similar to the cable 200, except as described below. As shown, the cable 300 includes a core 302, an inner layer of armor wires 304, an outer layer of armor wires 306, and a polymeric jacket 308. As a non-limiting example, the jacket 308 is formed from a fiber reinforced polymer that encapsulates each of the layers 304, 306. As a non-limiting example, the jacket 308 includes a smooth outer surface 310 to reduce a frictional coefficient thereof. It is understood that various polymers and other materials can be used to form the jacket 308.

An outer surface of each of the layers 304, 306 includes a suitable metallic coating 312 or suitable polymer coating to bond to the polymeric jacket 308. Therefore, the polymeric jacket 308 becomes a composite in which the layers 304, 306 (e.g. high modulus steel strength members) are embedded and bonded in a continuous matrix of polymer from the core 302 to the outer surface 310 of the jacket 308. It is understood that the bonding of the layers 304, 306 to the jacket 308 minimizes stripping of the jacket 308.

Figure 4:
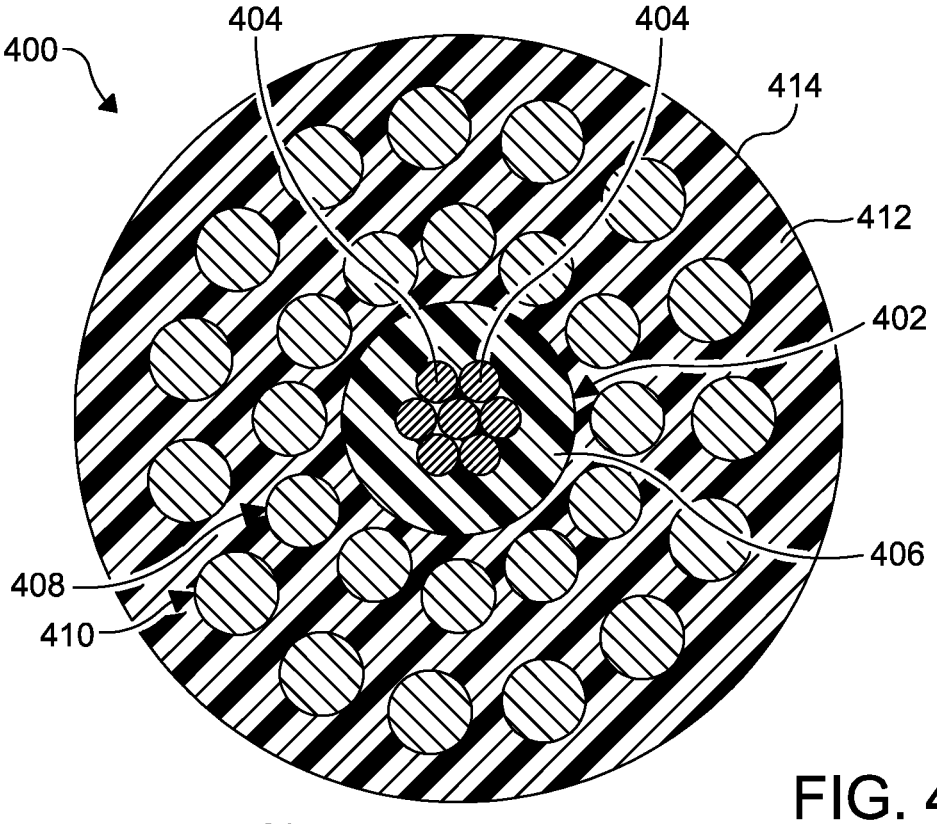

FIG. 4 illustrates a torque balanced cable 400 for tractor operations according to a third embodiment of the present invention similar to the cable 200, except as described below. As shown, the cable 400 includes a core 402 having a plurality of conductive strands 404 embedded in a polymeric insulator 406. It is understood that various materials can be used to form the conductive strands 404 and the insulator 406.

The core 402 is surrounded by an inner layer of armor wires 408 which is surrounded by an outer layer of alloy armor wires 410. An interstitial void created in the outer layer 410 (e.g. between adjacent ones of the armor wires of the outer layer 410) is filled with a polymer as part of a jacket 412. In the embodiment shown, the jacket 412 encapsulates at least each of the layers 408, 410. As a non-limiting example, the jacket 412 includes a substantially smooth outer surface 414 to minimize a friction coefficient thereof. It is understood that various polymers and other materials can be used to form the jacket 412. As a further non-limiting example, the jacket 412 is bonded to the insulator 406 disposed in the core 402. In certain embodiments, the coefficient of friction of a material forming the jacket 412 is lower than a coefficient of friction of a material forming the insulator 406. However, any materials having any coefficient of friction can be used.

Figure 5:
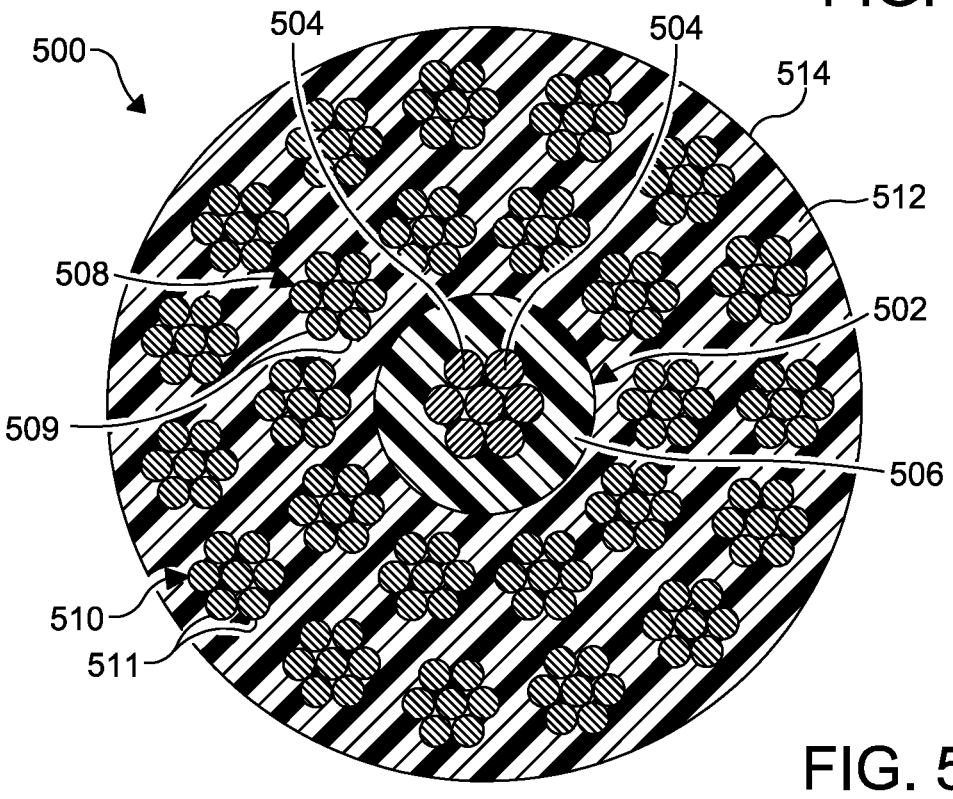

FIG. 5 illustrates a torque balanced cable 500 for tractor operations according to a fourth embodiment of the present invention similar to the cable 400, except as described below. As shown, the cable 500 includes a core 502 having a plurality of conductive strands 504 embedded in a polymeric insulator 506. It is understood that various materials can be used to form the conductive strands 504 and the insulator 506.

The core 502 is surrounded by an inner layer of armor wires 508, wherein each of the armor wires of the inner layer 508 is formed from a plurality of metallic strands 509. The inner layer 508 is surrounded by an outer layer of armor wires 510, wherein each of the armor wires of the outer layer 510 is formed from a plurality of metallic strands 511. As a non-limiting example the layers 508, 510 are contra helically wound with each other. An interstitial void created in the outer layer 510 (e.g. between adjacent ones of the armor wires of the outer layer 510) is filled with a polymer as part of a jacket 512. In the embodiment shown, the jacket 512 encapsulates at least each of the layers 508, 510. As a non-limiting example, that jacket 512 includes a substantially smooth outer surface 514 to minimize a friction coefficient thereof.

Figure 6:
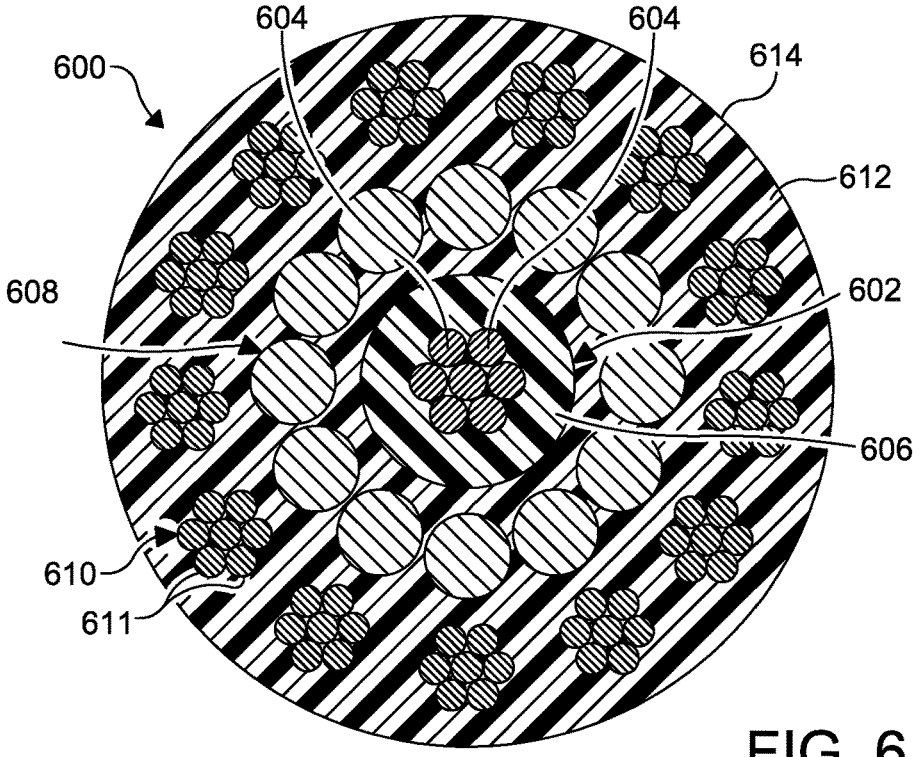

FIG. 6 illustrates a torque balanced cable 600 for tractor operations according to a fifth embodiment of the present invention similar to the cable 400, except as described below. As shown, the cable 600 includes a core 602 having a plurality of conductive strands 604 embedded in a polymeric insulator 606. It is understood that various materials can be used to form the conductive strands 604 and the insulator 606.

The core 602 is surrounded by an inner layer of armor wires 608, wherein each of the armor wires of the inner layer is formed from a single strand. The inner layer 608 is surrounded by an outer layer of armor wires 610, wherein each of the armor wires of the outer layer 610 is formed from a plurality of metallic strands 611. As a non-limiting example the layers 608, 610 are contra helically wound with each other. An interstitial void created in the outer layer 610 (e.g. between adjacent ones of the armor wires of the outer layer 610) is filled with a polymer as part of a jacket 612. In the embodiment shown, the jacket 612 encapsulates at least each of the layers 608, 610. As a non-limiting example, that jacket 612 includes a substantially smooth outer surface 614 to minimize a friction coefficient thereof.

Figure 7:
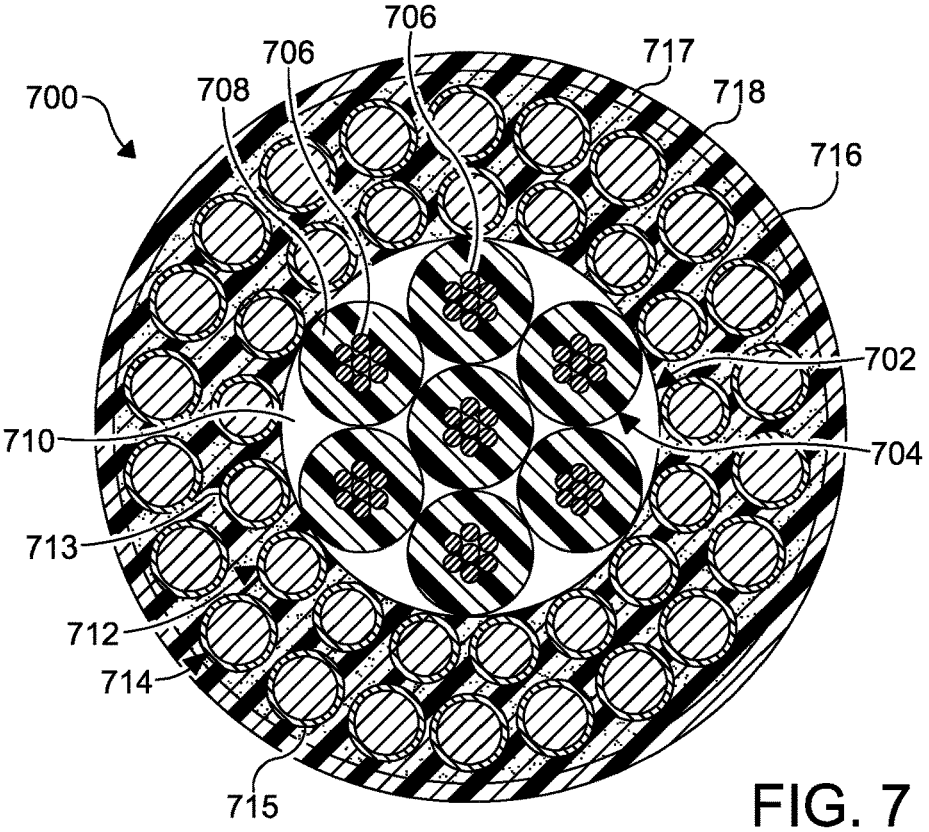

FIG. 7 illustrates a torque balanced cable 700 for tractor operations according to a sixth embodiment of the present invention similar to the cable 300, except as described below. As shown, the cable 700 includes a core 702 having a plurality of conductors 704. As a non-limiting example, each of the conductors 704 is formed from a plurality of conductive strands 706 with an insulator 708 disposed therearound. In certain embodiments an interstitial void 710 formed between adjacent insulators 708 is filled with semi-conductive or non-conductive filler (e.g. filler strands, insulated filler).

The core 702 is surrounded by an inner layer of armor wires 712 which is surrounded by an outer layer of armor wires 714. As a non-limiting example the layers 712, 714 are contra helically wound with each other. An outer surface of each of the layers 712, 714 includes a suitable metallic coating 713, 715 or suitable polymer coating to bond to a polymeric jacket 716 encapsulating each of the layers 712, 714. As a non-limiting example, at least a portion of the jacket 716 is formed from a fiber reinforced polymer.

In the embodiment shown, an outer circumferential portion 717 of the jacket 716 (e.g. 1 to 15 millimeters) is formed from polymeric material without reinforcement fibers disposed therein to provide a smooth outer surface 718. As a non-limiting example, the outer circumferential portion 717 may be formed from virgin polymeric material or polymer materials amended with other additives to minimize a coefficient of friction. As a further non-limiting example, a non-fiber reinforced material is disposed on the jacket 716 and chemically bonded thereto.

Figure 8:
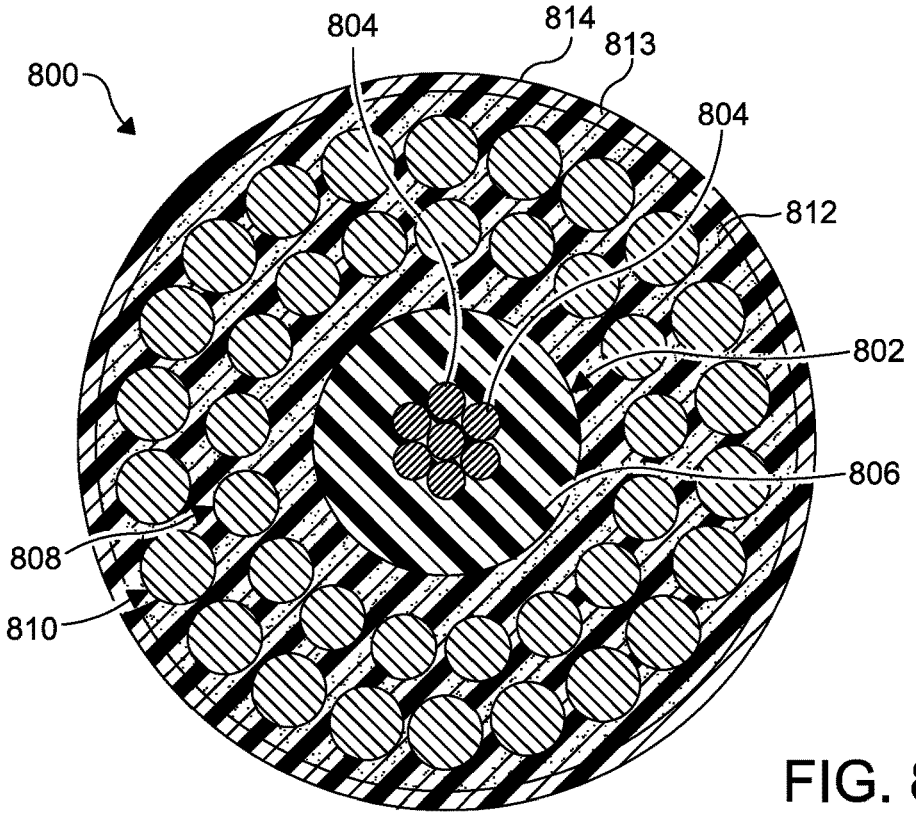

FIG. 8 illustrates a torque balanced cable 800 for tractor operations according to a seventh embodiment of the present invention similar to the cable 400, except as described below. As shown, the cable 800 includes a core 802 having a plurality of conductive strands 804 embedded in a polymeric insulator 806. It is understood that various materials can be used to form the conductive strands 804 and the insulator 806.

The core 802 is surrounded by an inner layer of armor wires 808. The inner layer 808 is surrounded by an outer layer of armor wires 810. As a non-limiting example the layers 808, 810 are contra helically wound with each other. An interstitial void created in the outer layer 810 (e.g. between adjacent ones of the armor wires of the outer layer 810) is filled with a polymer as part of a jacket 812. As a non-limiting example, at least a portion of the jacket 812 is formed from a fiber reinforced polymer. As a further non-limiting example, the jacket 812 encapsulates at least each of the layers 808, 810.

In the embodiment shown, an outer circumferential portion 813 of the jacket 812 (e.g. 1 to 15 millimeters) is formed from polymeric material without reinforcement fibers disposed therein to provide a smooth outer surface 814. As a non-limiting example, the outer circumferential portion 813 may be formed from virgin polymeric material or polymer materials amended with other additives to minimize a coefficient of friction. As a further non-limiting example, a non-fiber reinforced material is disposed on the jacket 812 and chemically bonded thereto.

Figure 9:
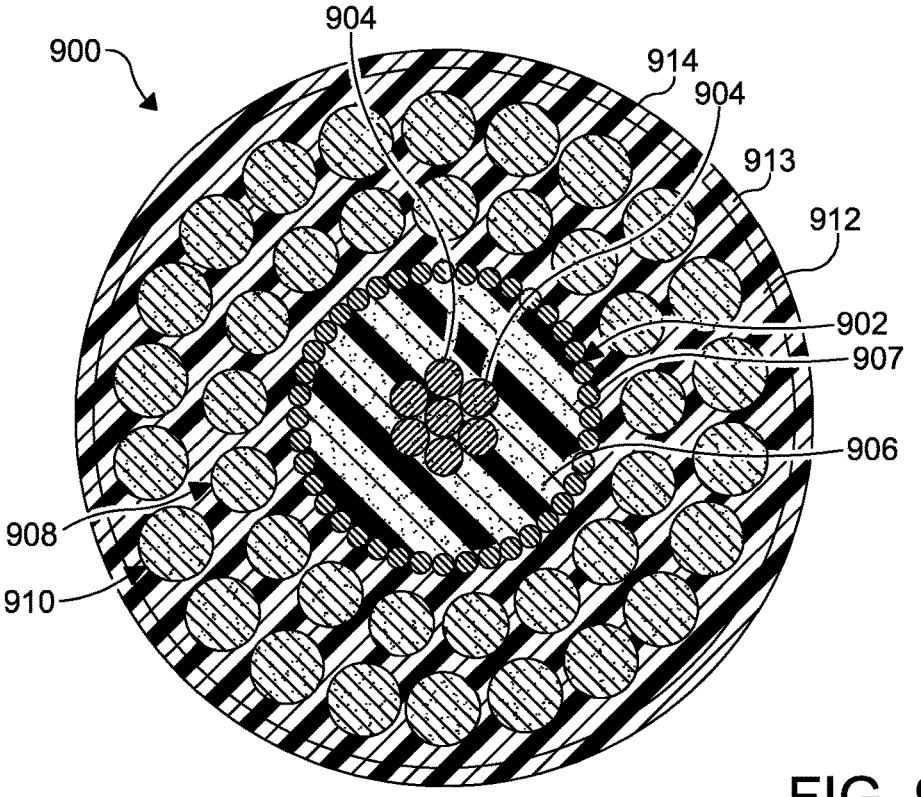

FIG. 9 illustrates a torque balanced cable 900 for tractor operations according to an eighth embodiment of the present invention similar to the cable 400, except as described below. As shown, the cable 900 includes a core 902 having a plurality of conductive strands 904 embedded in a polymeric insulator 906. It is understood that various materials can be used to form the conductive strands 904 and the insulator 906. The core 902 includes an annular array of shielding wires 907 circumferentially disposed adjacent a periphery of the core 902, similar to conventional coaxial cable configurations in the art. As a non-limiting example, the shielding wires 907 are formed from copper. However, other conductors can be used.

The core 902 and the shielding wires 907 are surrounded by an inner layer of armor wires 908. The inner layer 908 is surrounded by an outer layer of armor wires 910. As a non-limiting example the layers 908, 910 are contra helically wound with each other. An interstitial void created in the outer layer 910 (e.g. between adjacent ones of the armor wires of the outer layer 910) is filled with a polymer as part of a jacket 912. As a non-limiting example, at least a portion of the jacket 912 is formed from a fiber reinforced polymer. In the embodiment shown, the jacket 912 encapsulates at least each of the layers 908, 910.

In the embodiment shown, an outer circumferential portion 913 of the jacket 912 (e.g. 1 to 15 millimeters) is formed from polymeric material without reinforcement fibers disposed therein to provide a smooth outer surface 914. As a non-limiting example, the outer circumferential portion 913 may be formed from virgin polymeric material or polymer materials amended with other additives to minimize a coefficient of friction. As a further non-limiting example, a non-fiber reinforced material is disposed on the jacket 912 and chemically bonded thereto.

Figure 10:
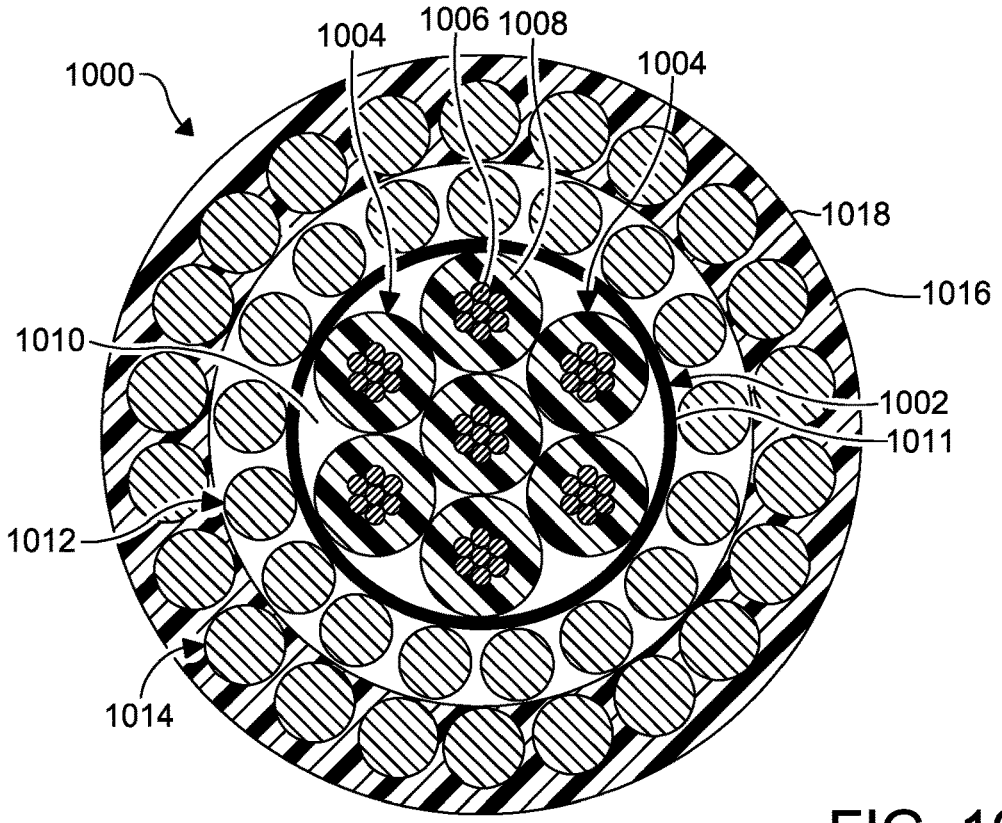

FIG. 10 illustrates a torque balanced cable 1000 for tractor operations according to a ninth embodiment of the present invention similar to the cable 200, except as described below. As shown, the cable 1000 includes a core 1002 having a plurality of conductors 1004. As a non-limiting example, each of the conductors 1004 is formed from a plurality of conductive strands 1006 with an insulator 1008 disposed therearound. In certain embodiments an interstitial void 1010 formed between adjacent insulators 1008 is filled with semi-conductive or non-conductive filler (e.g. filler strands, insulator filler). As a further non-limiting example, a layer of insulative material 1011 (e.g. polymer) is circumferentially disposed around the core 1002.

The core 1002 and the insulative material 1011 are surrounded by an inner layer of armor wires 1012 which is surrounded by an outer layer of armor wires 1014. A polymer jacket 1016 is circumferentially disposed (e.g. pressure extruded) on to the outer layer 1014 to fill an interstitial void between the members of the outer layer 1014. As a non-limiting example, that jacket 1016 includes a substantially smooth outer surface 1018 to minimize a friction coefficient thereof. As shown, the jacket 1016 is applied only on the outer layer 1014 and does not abut the core 1002 or the layer of insulative material 1011. In certain embodiments, the jacket 1016 is not chemically or physically bonded to the members of the outer layer 1014.

Figure 11:
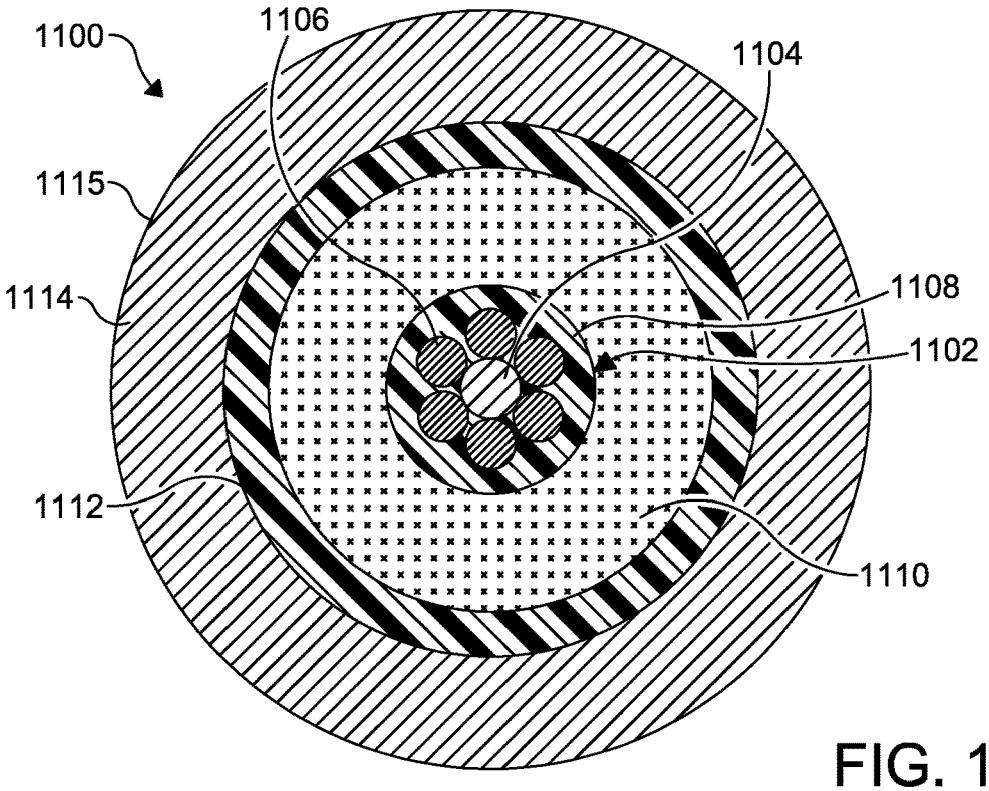

FIG. 11 illustrates a torque balanced cable 1100 for tractor operations according to a tenth embodiment of the present invention. As shown, the cable 1100 includes a core 1102 having an optical fiber 1104 centrally disposed therein. A plurality of conductive strands 1106 are disposed around the optical fiber 1104 and embedded in an insulator 1108. The core 1102 may comprise more than one optical fiber 1104 and/or conductive strands 1106 to define multiple power and telemetry paths for the cable 1100.

The core 1102 is surrounded by an inner strength member layer 1110 which is typically formed from a composite long fiber reinforced material such as a U/V-curable or thermal curable epoxy or thermoplastic. As a non-limiting example, the inner armor layer 1110 is pultruded or rolltruded over the core 1102. As a further non-limiting example, a second layer (not shown) of virgin, U/V-curable or thermal curable epoxy is extruded over the inner armor layer 1110 to create a more uniformly circular profile for the cable 1100.

A polymeric jacket 1112 may be extruded on top of the inner strength member layer 1110 to define a shape (e.g. round) of the cable 1100. An outer metallic tube 1114 is drawn over the jacket 1112 to complete the cable 1100. As a non-limiting example, the outer metallic tube 1114 includes a substantially smooth outer surface 1115 to minimize a friction coefficient thereof. The outer metallic tube 1114 and the inner armor layer 1110 advantageously act together or independently as strength members. Each of the inner strength member layer 1110 and the outer metallic tube 1114 are at zero lay angles, therefore, the cable 1100 is substantially torque balanced.

Figure 12:
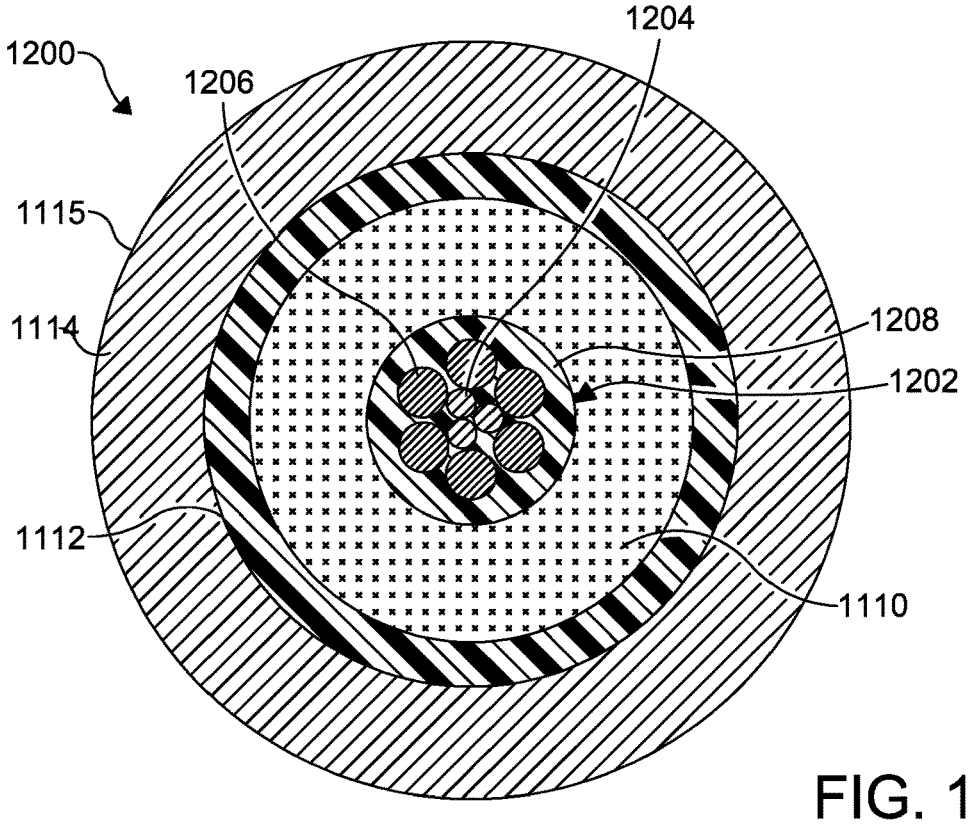

FIG. 12 illustrates a torque balanced cable 1200 for tractor operations according to an eleventh embodiment of the present invention similar to the cable 1100, except as described below. As shown, the cable 1200 includes a core 1202 having a plurality of optical fibers 1204 disposed therein. A plurality of conductive strands 1206 are disposed around the optical fibers 1204 and embedded in an insulator 1208. The core 1202 may comprise more than one optical fiber 1204 and/or conductive strands 1206 to define multiple power and telemetry paths for the cable 1200.

Figure 13:
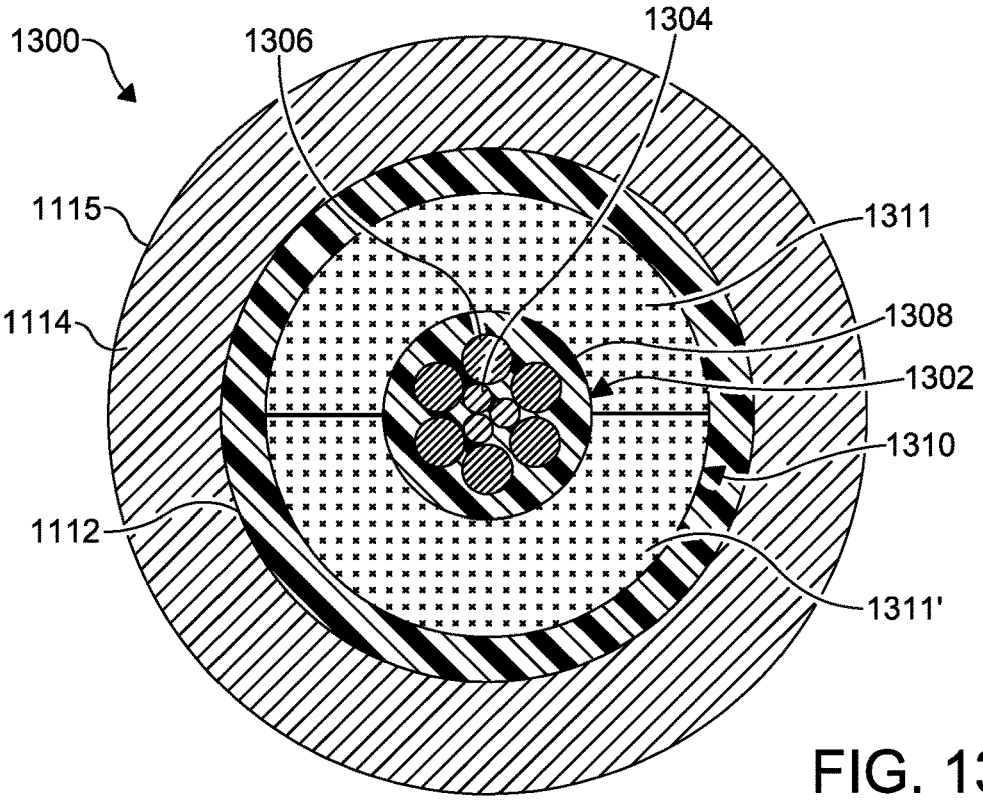

FIG. 13 illustrates a torque balanced cable 1300 for tractor operations according to a twelfth embodiment of the present invention similar to the cable 1100, except as described below. As shown, the cable 1300 includes a core 1302 having a plurality of optical fibers 1304 disposed therein. A plurality of conductive strands 1306 are disposed around a configuration of the optical fibers 1304 and embedded in an insulator 1308.

The core 1302 is surrounded by an inner strength member layer 1310 which is typically formed from a composite long fiber reinforced material such as a U/V-curable or thermal curable epoxy or thermoplastic. As a non-limiting example, the inner armor layer 1310 is pultruded or rolltruded over the core 1302. As a further non-limiting example, the inner armor layer 1310 is formed as a pair of strength member sections 1311, 1311', each of the sections 1311, 1311' having a semi-circular shape when viewed in axial cross-section.

Figure 14:
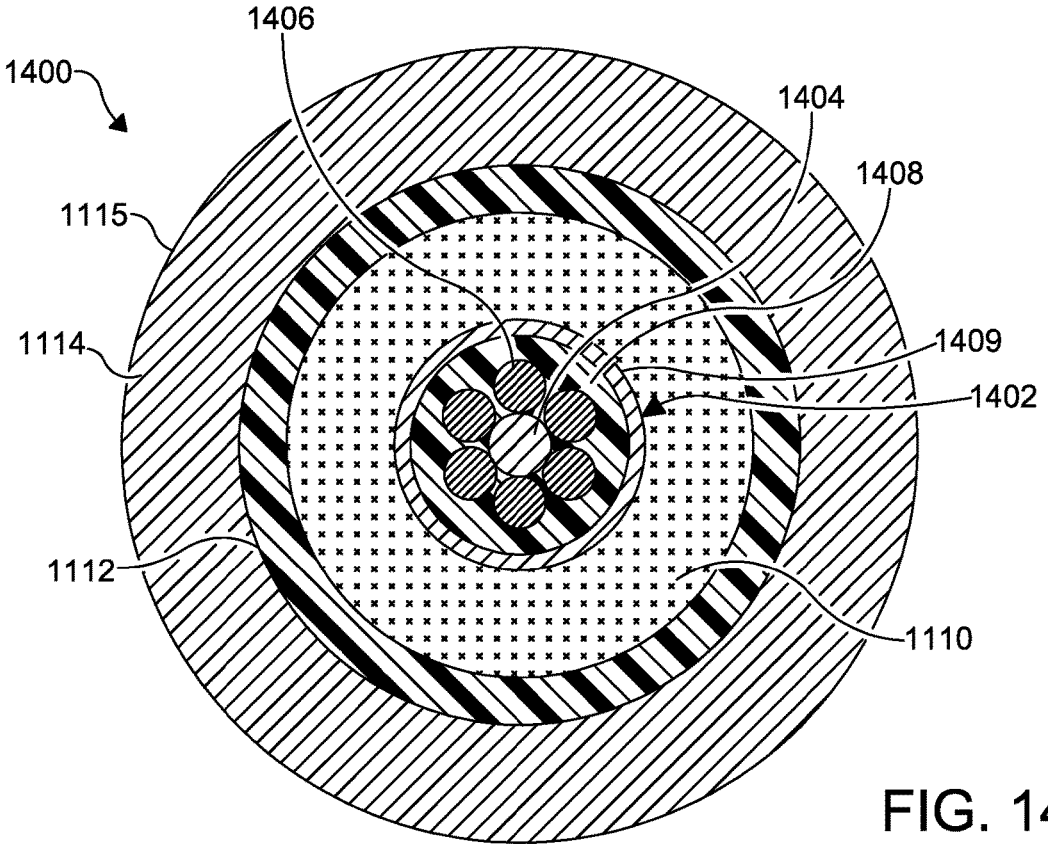

FIG. 14 illustrates a torque balanced cable 1400 for tractor operations according to a thirteenth embodiment of the present invention similar to the cable 1100, except as described below. As shown, the cable 1400 includes a core 1402 having an optical fiber 1404 centrally disposed therein. A plurality of conductive strands 1406 are disposed around the optical fiber 1404 and embedded in an insulator 1408. The core 1402 is surrounded by an inner metallic tube 1409 having a lay angle of substantially zero. It is understood that the inner metallic tube 1409 can have any size and thickness and may be utilized as a return path for electrical power.

The polymeric materials useful in the cables of the invention may include, by nonlimiting example, polyolefins (such as EPC or polypropylene), other polyolefins, polyaryletherether ketone (PEEK), polyaryl ether ketone (PEK), polyphenylene sulfide (PPS), modified polyphenylene sulfide, polymers of ethylene-tetrafluoroethylene (ETFE), polymers of poly(1,4-phenylene), polytetrafluoroethylene (PTFE), perfluoroalkoxy (PFA) polymers, fluorinated ethylene propylene (FEP) polymers, polytetrafluoroethylene-perfluoromethylvinylether (MFA) polymers, Parmax®, any other fluoropolymer, and any mixtures thereof. The long fiber used in the composite of UN-curable or thermal curable epoxy or thermoplastic may be carbon fiber, glass fiber, or any other suitable synthetic fiber.

Embodiments disclosed herein describe a method and a cable design for use of a wireline cable comprising a torque balanced armor wire and very smooth, low coefficient of friction outer surface to be attached to a tractor that will reduce the weight the tractor has to carry, lower the friction the tractor has to overcome to pull the cable and the tool string through the wellbore and to avoid knotting and birdcaging associated with sudden loss of tension on the wireline cable in such operations.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

I claim:

1. A method for making a wireline cable available for use in a wellbore, comprising:

providing a torque balanced wireline cable, wherein the wireline cable is suitable and adapted for use in a wellbore, the cable comprising a cable core with two layers of armor wire disposed thereabout, wherein an outer layer of armor wire covers less than an entire circumference of an inner armor wire layer, and a substantially smooth exterior surface disposed about the armor wire layers and the cable core, wherein the cable is configured to attach to downhole equipment and for use in a downhole environment, wherein the coverage of the outer layer over the inner layer is from about 60% to about 88%.

2. The method according to claim 1, further comprising a smooth metallic outer tube and at least one polymeric layer disposed between the cable core and the smooth metallic outer tube.

3. The method according to claim 1, wherein the cable core comprises a plurality of conductive strands disposed adjacent each other and embedded in an insulator.

4. The method according to claim 1, wherein the cable core comprises an annular array of shielding wires circumferentially disposed adjacent a periphery of the cable core.

5. The method according to claim 1, further comprising a layer of insulative material disposed between the cable core and the inner armor wire layer.

6. The method according to claim 1, wherein at least one of the inner armor wire layer and the outer armor wire layer includes at least one armor wire formed from conductive strands.

7. The method according to claim 1, further comprising a jacket encapsulating at least one of the inner armor wire layer and the outer armor wire layer.

8. The method according to claim 7, wherein the jacket is bonded to the at least one of the inner armor wire layer and the outer armor wire layer.

9. The method according to claim 8, wherein an outer surface of the jacket comprises the substantially smooth exterior surface.

10. The method according to claim 8, wherein the jacket is formed from a fiber reinforced polymer.

11. The method according to claim 10, wherein a circumferential portion of the jacket is formed from non-fiber reinforced polymer having a substantially smooth outer surface.

12. The method according to claim 1, further comprising attaching a tool string to the cable and performing at least one well service operation.

13. The method according to claim 1, wherein the cable core includes a plurality of conductive strands disposed adjacent each other and embedded in an insulator.

14. The method according to claim 1, wherein the cable core comprises an optical fiber disposed therein.

15. The method according to claim 1, wherein the inner armor layer is formed from a long fiber reinforced material.

16. The method according to claim 1, wherein the outer armor layer has a substantially smooth outer surface.

17. The method according to claim 1, further comprising a polymeric jacket disposed around the inner armor layer and between the inner armor layer and the outer armor layer.

18. The method according to claim 1, further comprising a layer of metallic material circumferentially disposed around the cable core and between the cable core and the inner armor layer.

* * * * *